United States Patent [19]

Holcombe et al.

[11] Patent Number: 4,550,412

[45] Date of Patent: Oct. 29, 1985

[54] CARBON-FREE INDUCTION FURNACE

[75] Inventors: Cressie E. Holcombe; David R. Masters, both of Knoxville; William A. Pfeiler, Norris, all of Tenn.

[73] Assignee: The United States of America as represented by the United States Department of Energy, Washington, D.C.

[21] Appl. No.: 568,770

[22] Filed: Jan. 6, 1984

[51] Int. Cl.[4] ..... F27B 14/10; H05B 1/16

[52] U.S. Cl. ..... 373/155; 219/10.49 R

[58] Field of Search ..... 373/138, 141, 151, 155, 373/156, 27; 219/10.49 R

[56] References Cited

U.S. PATENT DOCUMENTS

| | | | |
|---|---|---|---|
| 3,470,304 | 9/1969 | Geringer | 219/10.49 R |
| 3,916,047 | 10/1975 | Niesen | 373/155 X |
| 4,351,058 | 9/1982 | Florian et al. | 373/156 X |

FOREIGN PATENT DOCUMENTS

| | | | |
|---|---|---|---|
| 0608041 | 9/1948 | United Kingdom | 373/27 |
| 937213 | 9/1963 | United Kingdom | 373/156 |

*Primary Examiner*—G. P. Tolin
*Assistant Examiner*—Gregory D. Thompson
*Attorney, Agent, or Firm*—Earl L. Larcher; Stephen D. Hamel; Judson R. Hightower

[57] ABSTRACT

An induction furnace for melting and casting highly pure metals and alloys such as uranium and uranium alloys in such a manner as to minimize contamination of the melt by carbon derived from the materials and the environment within the furnace. The subject furnace is constructed of carbon free materials and is housed within a conventional vacuum chamber. The furnace comprises a ceramic oxide crucible for holding the charge of metal or alloy. The heating of the crucible is achieved by a plasma-sprayed tungsten susceptor surrounding the crucible which, in turn, is heated by an RF induction coil separated from the susceptor by a cylinder of inorganic insulation. The furnace of the present invention is capable of being rapidly cycled from ambient temperatures to about 1650° C. for effectively melting uranium and uranium alloys without the attendant carbon contamination problems previously encountered when using carbon-bearing furnace materials.

6 Claims, 1 Drawing Figure

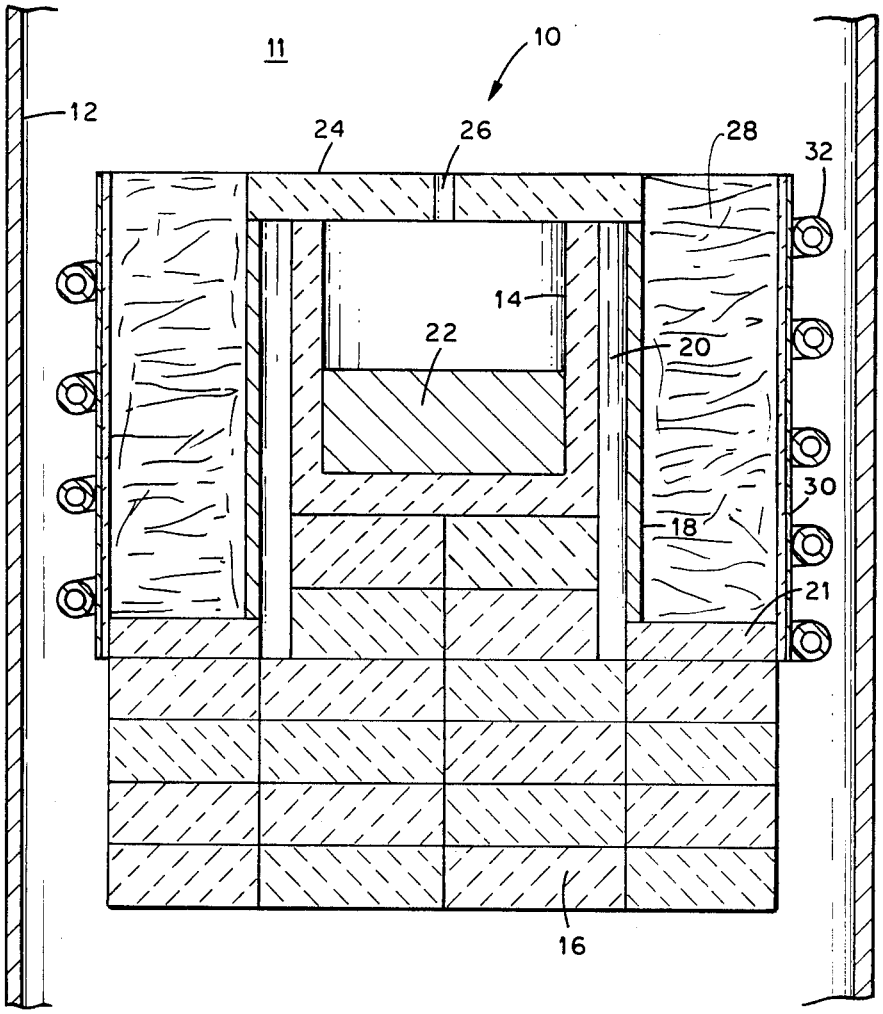
11
10
12
24
26
28
32
14
22
20
30
18
21
16

CARBON-FREE INDUCTION FURNACE

This invention was made as a result of work under Contract W-7405-ENG-26 between the Union Carbide Corporation, Nuclear Division and the U.S. Department of Energy.

BACKGROUND OF THE INVENTION

The present invention relates generally to an induction furnace for melting or casting reactive metals or alloys such as uranium metal or uranium alloys, and more particularly to an induction furnace constructed of carbon-free materials so as to inhibit the contamination of the melted metal or alloy with carbon impurities.

Induction heated furnaces have been used extensively for melting and casting reactive metals such as uranium and uranium alloys. These induction furnaces commonly utilize graphite crucibles and graphite induction rings which are coated with protective oxide surfaces. Considerable problems are encountered in using induction furnaces in which these carbon bearing materials are utilized for the construction of the furnace in that moisture is absorbed by the induction rings, crucibles and the oxide coatings at ambient conditions during downtime of the furnace. The carbon and/or carbon oxides are in turn released from the moisturized graphite materials and the oxide coatings into the furnace environment during the melting of the reactive metals. As a result of this carbon, accurate control of the alloy compositions is considerably hampered since the carbon in the furnace environment reacts with the metal or alloy melt to contaminate the melt with carbon so as to considerably alter the physical properties of the metal or alloy. Other problems associated with known induction furnaces is in the use of zirconia thermal insulation since zirconia at certain levels of densities is a susceptor of the magnetic flux in the induction furnace which caused considerable susceptor arcing with the induction coil and often resulted in damaging the induction coil and disrupting the furnace operation.

Efforts to decrease the carbon contamination of melts in induction furnaces include the coating of the graphite crucibles with various oxides such as yttria and the like. However, even with such essentially impermeable coatings sufficient carbon is still derived from the crucibles and graphite susceptor rings so as to excessively contaminate the melt with carbon.

SUMMARY OF THE INVENTION

Accordingly, it is the primary aim or objective of the present invention to provide an induction heated furnace in which carbon-free bearing materials are utilized for the fabrication of the furnace so as to inhibit contamination of the melts of the reactive metals such as uranium or uranium alloys with carbon derived from the furnace construction material.

Generally, the furnace of the present invention is a carbon-free induction furnace formed of carbon-free bearing materials which provide for a melt of a metal or metal alloy that is characterized by being essentially free of carbon impurities derived from furnace components. The furnace comprises a carbon-free refractory oxide crucible for containing a charge of the metal or alloy. A cylindrical susceptor of tungsten is disposed about the crucible. Thermal insulation is, in turn, disposed about the susceptor with the insulation being of a sufficiently low density to minimize induction heating or suscepting thereof. Refractory oxide support means are utilized for supporting the crucible within the tungsten susceptor. Electrical insulating means are disposed about the thermal insulation and induction heating means are arranged to inductively heat the susceptor through the electrical insulating means and the thermal insulation before heating the crucible and the contents therein to a temperature sufficient to provide the melt of metal or alloy.

By fabricating a furnace of non-carbon bearing materials, all potentially contaminating carbon is essentially eliminated from the furnace environment during melting and casting operations at temperatures up to about 1650° C. The use of a tungsten susceptor formed by plasma spraying provides a susceptor capable of withstanding rapid heating rates and temperature cycling so as to provide for the heating of the contents of the crucible in the heating cycles required of the particular metal or alloy.

Other and further objects of the invention will be obvious upon an understanding of the illustrative embodiment about to be described or will be indicated in the appended claims, and various advantages not referred to herein will occur to one skilled in the art upon employment of the invention in practice.

DESCRIPTION OF THE DRAWING

The FIGURE is a elevational sectional view of the carbon-free induction furnace of the present invention which is capable of melting or casting reactive metals and alloys without contaminating the melt with carbon derived from the furnace materials or environment.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated.

DETAILED DESCRIPTION OF THE INVENTION

Described generally, the induction furnace of the present invention is fabricated from carbon-free materials to inhibit undesirable carbon contamination of the metals or alloys such as uranium or uranium alloys being melted in the furnace. The furnace is positioned in a vacuum chamber and comprises an open-top refractory oxide crucible supported on a suitable structure of refractory oxide inside the vacuum chamber. The loaded crucible is covered with a refractory oxide lid and the contents therein are heated to the desired melting temperature by heat emanating from a cylindrical susceptor of plasma-sprayed tungsten disposed about the crucible. The susceptor is, in turn, heated by the magnetic flux emanating from an RF induction coil disposed about the susceptor. Thermal insulation is placed between the induction coil and the susceptor to retain heat within the furnace as well as reflect heat towards the susceptor. The thermal insulation is formed of a refractory oxide of a sufficiently low density to minimize suscepting or arcing with the RF coil. To further inhibit arcing between the RF coil and the thermal insulation a cylinder of electrical insulation is placed between the RF coil and the thermal insulation.

With reference to the accompanying FIGURE, the furnace of the present invention is generally shown at 10 and is constructed of noncarbon bearing materials so as to inhibit carbon impurities from contaminating the metals being heated in the furnace. The furnace 10 is encased within the cavity 11 of a vacuum chamber 12 which is of the conventional clam-shell type and which is capable of providing an vacuum atmosphere in the range of about 1 to 200 Pa for melting metals.

The furnace 10 comprises an open-topped cylindrical crucible 14 formed of a refractory or ceramic oxide composition containing alumina, silica, or zirconia. A composition of these materials which has proven to be particularly satisfactory for rapid heating and temperature cycling is a ceramic oxide formed of about 64 wt. % alumina, 23 wt. % zirconia, and 12 wt. % silica. This particular composition can be rapidly cycled through a broad temperature range and is resistance to thermal shock during such cyclings. Also, this ceramic oxide composition has a melting point of approximately 1760° C. which is suitable for melting uranium and uranium alloys. Another particularly useful composition contains 90 wt. % alumina and the remainder silica which melts above 1875° C. The crucible 14 is preferably constructed with a height-to-diameter ratio less than or equal to about 1 so as to minimize the bottom-to-top temperature differential which, if too great, would cause nonuniform melting and possibly deleterious cracking of the crucible. The crucible 14 is supported in the furnace 10 by a support structure formed of bricks 16 which are of a suitable high-temperature refractory or ceramic material such as alumina or the like which will withstand the heat within the furnace. The bricks 16 are stacked on the bottom or floor of the vacuum chamber 12 to hold the crucible 14 in the desired position within the furnace assembly as will be described in greater detail below.

In order to heat the crucible contents a susceptor 18 of cylindrical configuration is disposed about and radially spaced from the crucible 14 for defining an annulus 20 therebetween for providing uniform heat flow between a susceptor 18 and a crucible 14. As shown in the drawing, the susceptor 18 is of a length greater than the height of the crucible 14 which is supported by the bricks 16 at the upper end of the susceptor 18 so as to provide for more uniform heating of the crucible contents due to the heat rising within the furnace. The susceptor 18 is formed of tungsten, preferably plasma-sprayed tungsten with a wall thickness in the range of about 0.25 to about 1.25 cm. The plasma-sprayed tungsten susceptor is particularly suitable for use within the furnace of the present invention in that the plasma-sprayed tungsten susceptor is capable of withstanding rapid heating rates and temperature cycling. No degradation of the susceptor 18 was detected in a visual examination after ten temperature cycles in the range of 24° to 1600° C. Grain growth in a plasma-sprayed tungsten body is very limited so that degradation of the susceptor 18 by thermal creep is virtually eliminated. Further, oxidation of the susceptor 18 is dependent on the vacuum levels inside the furnace since tungsten oxides are volatile at high temperatures. This oxidation of the susceptor is a subliming condition that does not deteriorate the susceptor 18 formed of plasma-sprayed tungsten. Thus, using the plasma-sprayed susceptor 18 in the furnace 10 of the present invention the longevity of the furnace 10 is substantially increased over that of using a susceptor formed of another high-temperature susceptor material such as titanium. A support ring 21 may be disposed under the susceptor 18 for holding it off of the bricks 16. This support ring 21 may be formed of a ceramic material similar to that of the crucible 14.

When the metal or alloy to be melted is placed in the furnace crucible 14, as generally indicated by the melt 22, a lid 24 is placed over the open top of the crucible 14. The lid 24 is of a sufficient diameter to span the annulus 20 and overlie the susceptor 18. This lid 24 may be formed of any suitable ceramic material such as pulp-molded zirconia which has proven to be satisfactory. An aperture 26 may be provided through the lid 24 for viewing with a pyrometer or the like into the furnace crucible 14 during the melting of the metal or alloy.

Disposed about the susceptor 18 is a cylinder of thermal insulation 28. This thermal insulation is preferably composed of zirconia fibers at a relatively low density in the range of about 0.5 to 2 grams/cc which is sufficient to minimize suscepting and yet provides adequate thermal insulation within the furnace to maintain the heat in the area of the crucible 14. The cylinder of thermal insulation 28 is of a thickness in the range of about 2.5 to 5 cms. While the thermal insulation is preferably formed of the zirconia fibers other fibrous materials such as yttria may be utilized. Also, a nonorganic binder such as zirconium oxynitrate may be utilized to hold the fibers together or the fibers may be loosely packed into the space provided by the susceptor 18 and a cylinder of electrical insulation 30. The thermal insulation 28 provides minimal suscepting properties so as to assure that the heat generated within the furnace is primarily directed from the susceptor 18 towards the crucible 14. The thermal insulation 28 also provides a substantial degree of heat reflection so as to reflect the heat emanating from the susceptor 18 back towards the susceptor 18 to further increase the heating of the crucible 14 and its contents 22.

The cylinder of electrical insulation 30 is preferably formed of a fibrous material such as "Fiberfrax" which is commercially available from Carborundum Company. The cylinder of electrical insulation 30 is of a thickness in the range of about 4–10 mm and is placed about the thermal insulation 28 to assure that any suscepting occurring within the thermal insulation 28 will not damage or cause arcing between the thermal insulation in an RF heating coil 32. This RF coil 32 is a conventional, water-cooled induction coil and is disposed about the electrical insulation 30 so as to provide the RF field for heating the susceptor 18 through the electrical insulation 30 and the thermal insulation 28 which heats the crucible 14 and its contents 22.

In order to assure that the molten uranium or uranium alloys within the crucible 14 do not attack or wet the crucible material, a protective coating such as yttria may be placed on the inner surface of the crucible. Also, by using a crucible with an opening through the base and the positioning of a casting mold under the crucible 14 in place of some of the support bricks 16 and by using a conventional pouring rod, the furnace of the present invention may be used for casting purposes.

The furnace of the present invention is capable of withstanding heating rates in the range of about 500° to 1200° C. per hour. Also, the maximum furnace temperature desired for the particular melt may be obtained and repeated through temperature ranges of 25° to 1650° C. without degradation of the furnace materials. The furnace can be heated without a metal charge; i.e., no suscepting of the metal charge is required to attain temperature.

In a typical operation, a charge 22 of wrought uranium metal was loaded into the crucible 14 coated with yttria paint. The charge of uranium metal was melted at a temperature of 1200° C. in a vacuum of 107 Pa. Melting conditions were maintained for one hour then the charge was cooled in the vacuum chamber 12 to ambient temperature. The charge of wrought uranium was analyzed by chemical and spectrographic methods before and after the melting operations. The analysis of the uranium indicated that only 30 wppm of carbon was added to the charge of uranium during the melting operation. Conversely, about 50 to 100 wppm of carbon are usually added to the charge of uranium during melting operations in conventional induction furnaces with the same size crucible and charge but containing carbon-bearing components.

It will be seen that the present invention provides an induction furnace which is capable of substantially reducing the concentration of carbon impurities in melts of high-melting metals and alloys such as uranium and uranium alloys so as to assure that the physical characteristics of the metals or alloys are not excessively compromised by the addition of carbon impurities derived from the furnace environment.

We claim:

1. A carbon-free induction furnace formed of carbon-free materials for providing a melt of a metal or alloy characterized by being essentially free of carbon impurities derived from furnace components; comprising:

a carbon-free refractory oxide crucible for containing a charge of metal or alloy;

a cylindrical susceptor of tungsten disposed about said crucible;

a cylinder of thermal insulatin disposed about said susceptor with said thermal insulation being of sufficiently low density to minimize induction heating thereof;

refractory oxide support means for supporting siad crucible;

electrical insulating means disposed about said thermal insulation; and induction heating means arranged to inductively heat said susceptor through said electrical insulating means and said thermal insulation for heating said crucible and metal or alloy contents therein to a temperature sufficient to provide a melt.

2. A carbon-free induction furnace as claimed in claim 1 wherein said furnace is housed within a chamber under vacuum during the induction heating of said crucible and metal or alloy contents therein.

3. A carbon-free induction furnace as claimed in claim 1 wherein said induction heating means comprises a water-cooled RF coil disposed about said electrical insulating means, wherein said electrical insulation means comprises a cylinder of fibrous material disposed between said coil and said thermal insulation, and wherein said coil, said cylinder of electrical insulating, said thermal insulation, said susceptor and said crucible are coaxially disposed.

4. A carbon-free induction furnace as claimed in claim 1 wherein said thermal insulation comprises zirconia fibers in a bulk density in the range of about 0.5 to 2 g/cc.

5. A carbon-free induction furnace as claimed in claim 1 wherein said susceptor is a cylinder formed of plasma-sprayed tungsten in a thickness in the range of about 0.25 to 1.25 cm.

6. A carbon-free induction furnace as claimed in claim 1 wherein said crucible is formed of a composition selected from alumina and silica, alumina, silica and zirconia, zirconia, and a mixture of alumina, zirconia and silica.

* * * * *